US009466899B1

(12) United States Patent
Chen et al.

(10) Patent No.: US 9,466,899 B1
(45) Date of Patent: Oct. 11, 2016

(54) CONNECTOR AND DATA CABLE

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Ching-Jou Chen, New Taipei (TW); Wen-Hsiang Hung, New Taipei (TW); Chun-Bao Gu, Wuhan (CN); Hong-Mei Zhang, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/695,908

(22) Filed: Apr. 24, 2015

(30) Foreign Application Priority Data

Mar. 24, 2015 (CN) ..... 2015 1 0129708

(51) Int. Cl.
*H01R 12/00* (2006.01)
*H01R 12/70* (2011.01)
*H01R 25/00* (2006.01)

(52) U.S. Cl.
CPC ..... *H01R 12/7076* (2013.01); *H01R 25/00* (2013.01)

(58) Field of Classification Search
CPC H01R 12/7076; H01R 23/72; H01R 23/725; H01R 25/00
USPC ..... 439/78, 630, 660
See application file for complete search history.

(56) References Cited

U.S. PATENT DOCUMENTS 4,859,198 A * 8/1989 Owen ..... H01R 13/11 439/252
5,711,679 A * 1/1998 Spickler ..... H01R 23/6873 439/541.5
6,247,970 B1 * 6/2001 Ueno ..... H01R 13/6585 439/108
2010/0297893 A1 * 11/2010 Masuda ..... H01R 12/73 439/733.1
2012/0052741 A1 * 3/2012 Zhu ..... H01R 13/56 439/660

* cited by examiner

*Primary Examiner* — Khiem Nguyen
(74) *Attorney, Agent, or Firm* — Zhigang Ma

(57) ABSTRACT

A connector includes an insulation body, a first pin row, a second pin row, a first connection terminal row and a second connection terminal row. The insulation body includes a division portion and defines a first receiving groove and a second receiving groove positioned at two opposite sides of the division portion. The first pin row and the second pin row are attached to two opposite sides of the division portion. One of the ends of the first connection terminal row electrically connect to a motherboard, the other one of the ends of the first connection terminal row connect to the first pin row. One of the ends of the second connection terminal row electrically connect to the motherboard, the other one of the ends of the second connection terminal row connect to the second pin row. The disclosure also provides a data cable to connect the connector.

16 Claims, 7 Drawing Sheets

CONNECTOR AND DATA CABLE

CROSS-REFERENCE TO RELATED APPLICATIONS

This application claims priority to Chinese Patent Application No. 201510129708.1, filed on Mar. 24, 2015, the contents of which are incorporated by reference herein.

FIELD

The subject matter herein relates to a connection system including a connector and several storage devices.

BACKGROUND

Several connectors are connected to motherboards to connect to storage devices via data cables. The connector, the storage device and the data cable are connected one-to-one.

BRIEF DESCRIPTION OF THE DRAWINGS

Implementations of the present technology will now be described, by way of example only, with reference to the attached figures.

DETAILED DESCRIPTION

Figure 1:
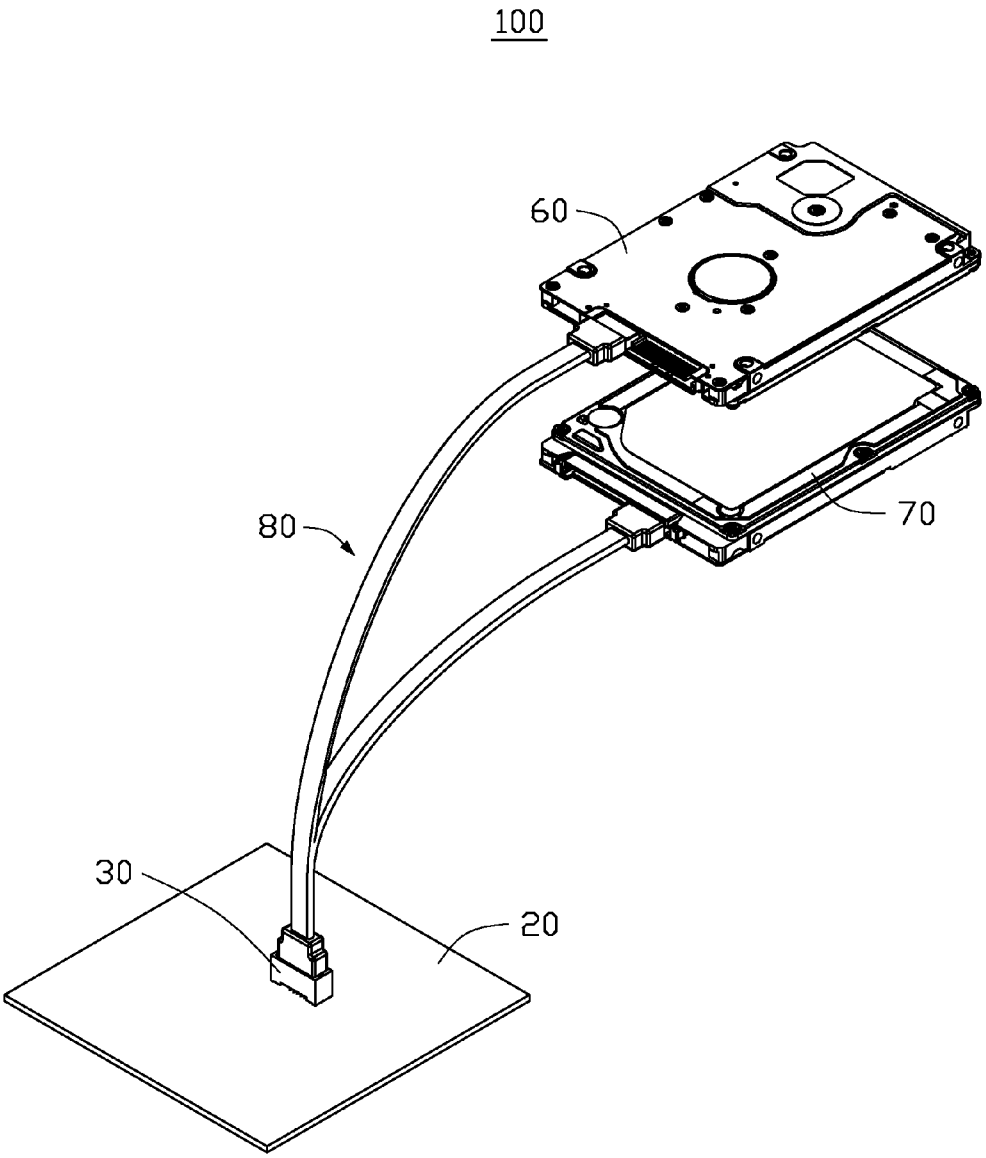
FIG. 1 is an isometric view of a connection system.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series, and the like.

Figure 2:
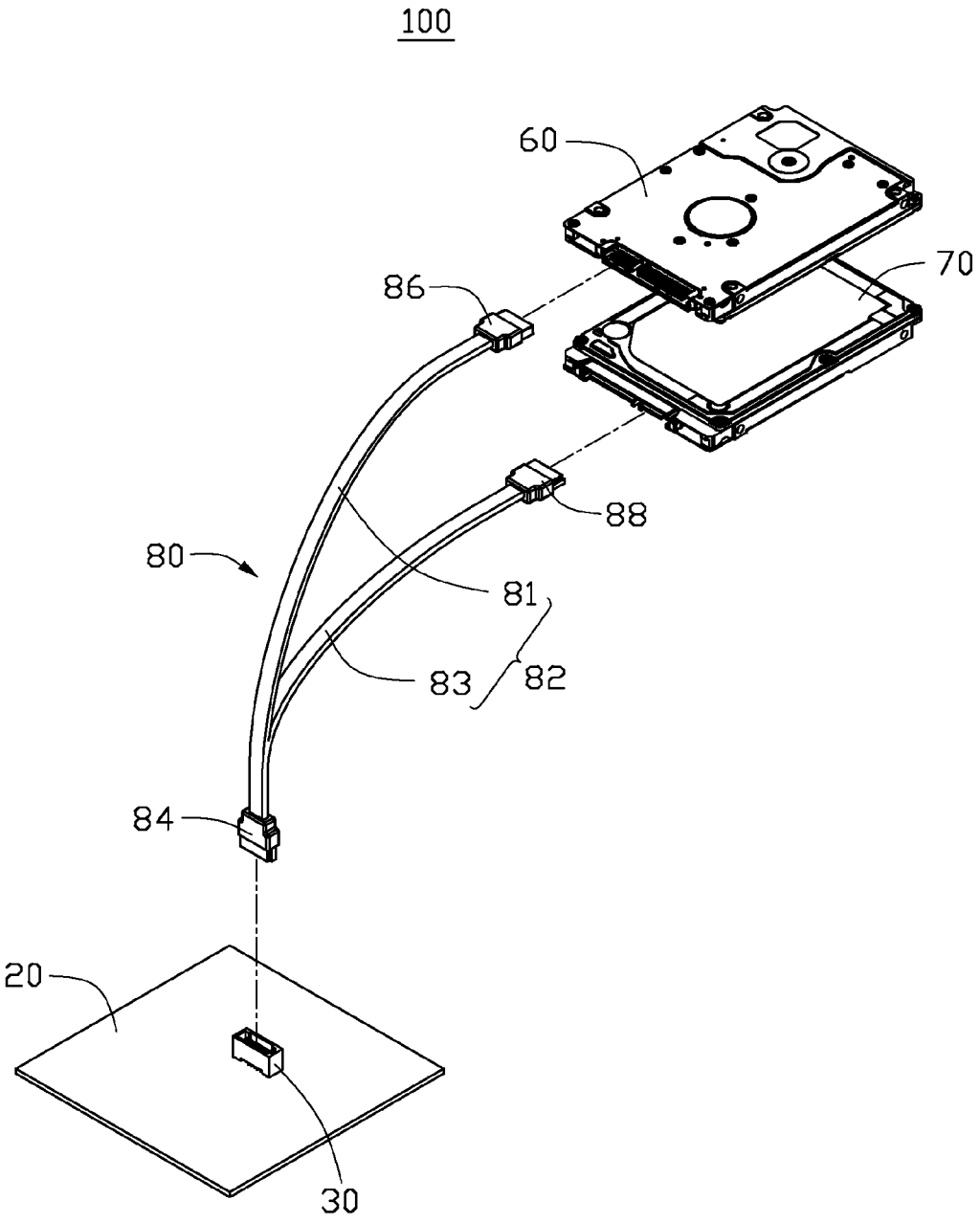
FIG. 2 is an exploded isometric view of the connection system in FIG. 1.

FIGS. 1 and 2 illustrate a connection system 100 includes a motherboard 20, a connector 30 connected to the motherboard 20, a first storage device 60, a second storage device 70 and a data cable 80. One end of the data cable 80 includes a connection port 84. The other end of the data cable 80 includes a first data port 86 and a second data port 88. The connection port 84 connects to the connector 30. The first data port 86 and the second data port 88 respectively connect to data ports of the first storage device 60 and the second storage device 70. The motherboard 20 is connected to the first storage device 60 and the second storage device 70 through the connector 30 and the data cable 80.

Figure 3:
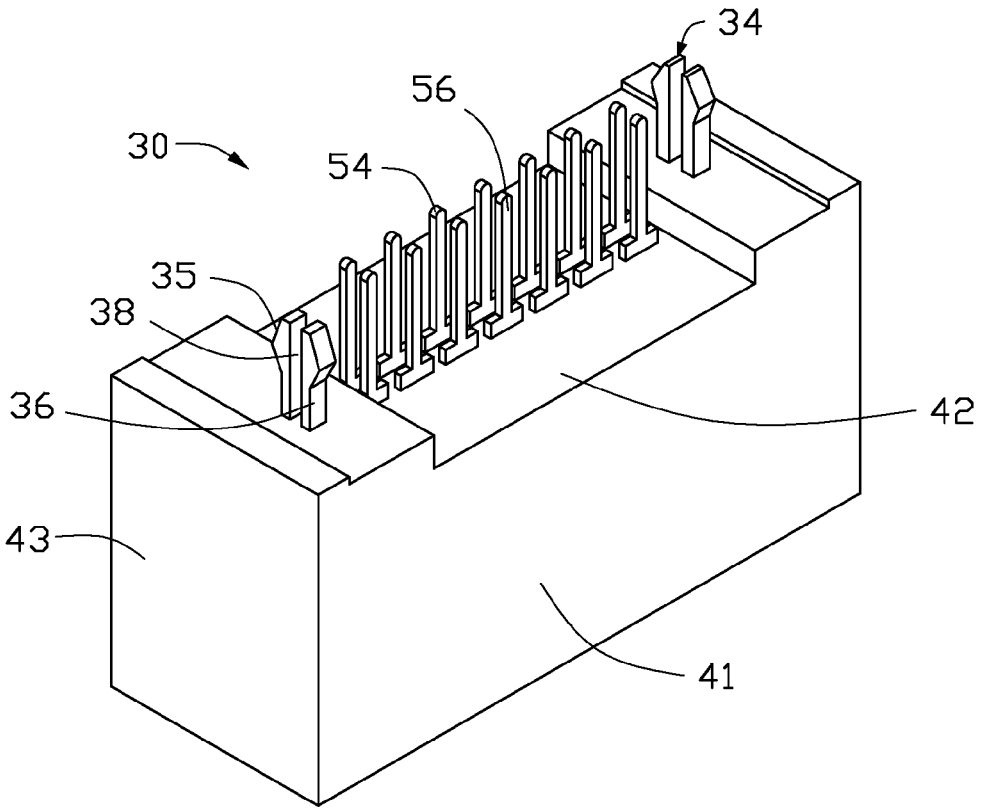
FIG. 3 is an isometric view of a connector of the connection system in FIG. 1 viewed from a first angle.
Figure 4:
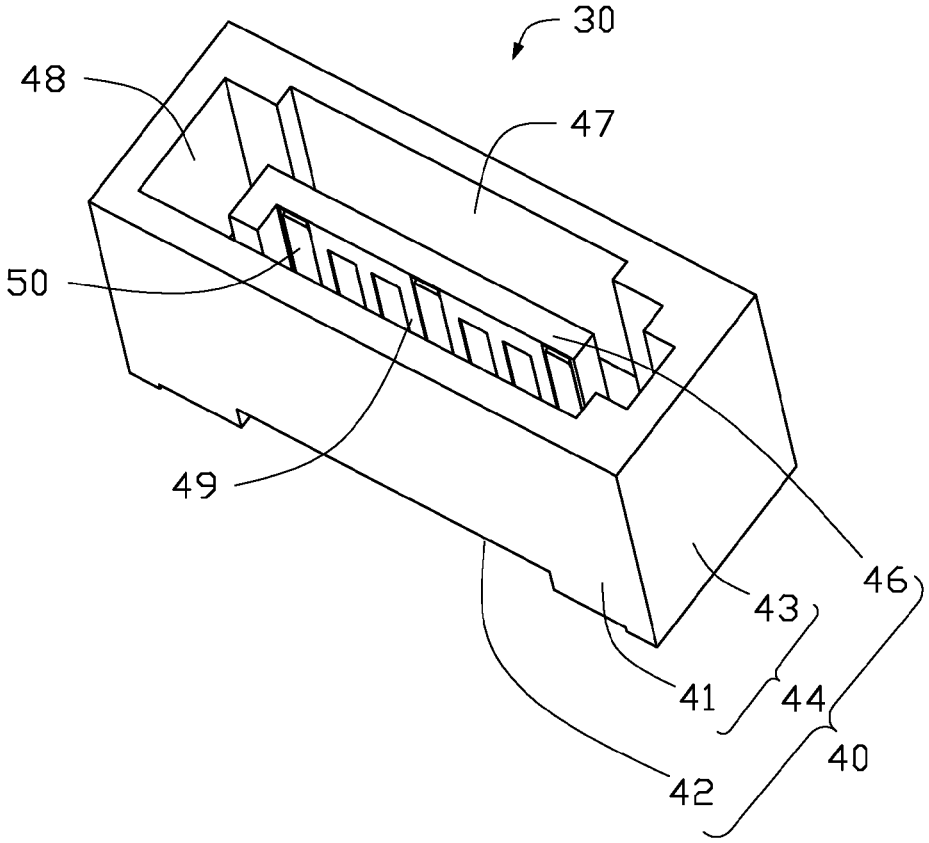
FIG. 4 is an isometric view of a connector of the connection system in FIG. 1 viewed from a second angle.
Figure 5:
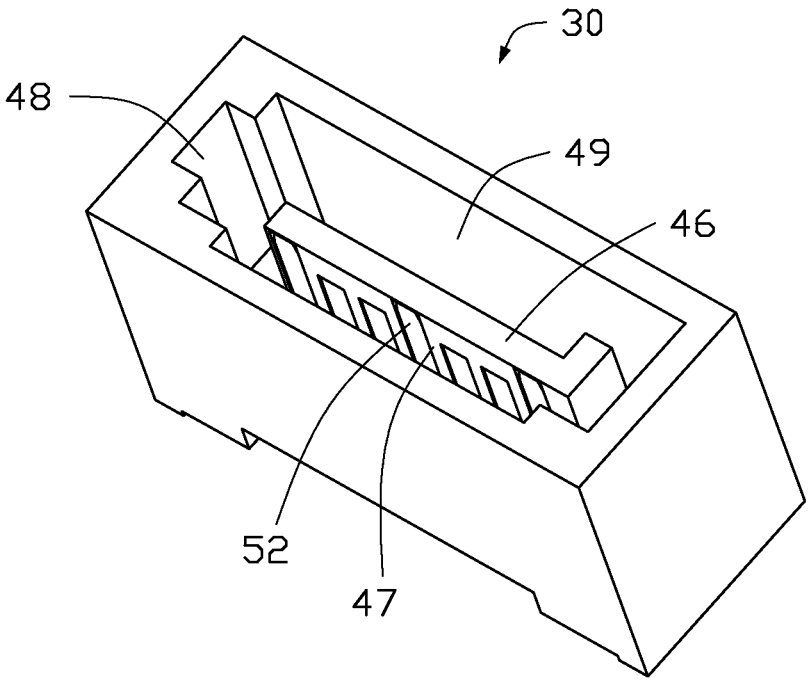
FIG. 5 is an isometric view of a connector of the connection system in FIG. 1 viewed from a third angle.

FIGS. 3 to 5 illustrate the connector includes an insulation body 40, a first pin row 50, a second pin row 52, a first connection terminal row 54 and a second connection terminal row 56. The insulation body 40 includes a bottom portion 42, a sidewall 44 surrounding the edge of the bottom portion 42 and a division portion 46. The sidewall 44 includes two first sidewalls 41 and two second sidewalls 43. The two first sidewalls 41 are opposite and parallel to each other. The two second sidewalls 42 are opposite and parallel to each other. The two first sidewalls 41 are attached to the two second sidewalls 43. The bottom portion 42, the first sidewall 41 and the second sidewall 43 together define an opening 48. The division portion 46 is perpendicularly attached to the bottom portion 42 and positioned parallel between the two first sidewalls 41 to divide the opening 48 to a first receiving groove 47 and the second receiving groove 49.

The first pin row 50 and the second pin row 52 are respectively attached to two sides of the division portion 46 opposite to the two first sidewalls 41. The first pin row 50 and the second pin row 52 are perpendicular to the bottom portion 42. The first connection terminal row 54 is attached to the bottom portion 42. One of the ends of the first connection terminal row 54 touch the first pin row 50, the other one of the ends of the first connection terminal row 54 is connected to the motherboard 20. The second connection terminal row 56 is attached to the bottom portion 42. One of the ends of the second connection terminal row 56 touch the second pin row 52, the other one of the ends of the second connection terminal row 56 is connected to the motherboard 20. Thus, signal of the motherboard 20 is transmitted to the first pin row 50 and the second pin row 52 through the first connection terminal row 54 and the second connection terminal row 56.

The insulation body 40 further includes a clasping member 34 attached to a side of the bottom portion 42 facing the motherboard 20. The clasping member 34 includes two elastic members 36. A gap 38 is defined between the two elastic members 36. An end of the elastic member 36 away from the bottom portion 42 includes a hook portion 35. The motherboard 20 defines two through holes (not shown) for receiving the hook portions 35. When the hook portions 35 move to the through hole of the motherboard 20, the hook portions 35 are deformed to pass through the through hole. When the hook portions 35 pass through the through hole, the hook portions 35 release the elastic force to hook the motherboard 20 attaching the connector 30 to the motherboard 20.

Figure 6:
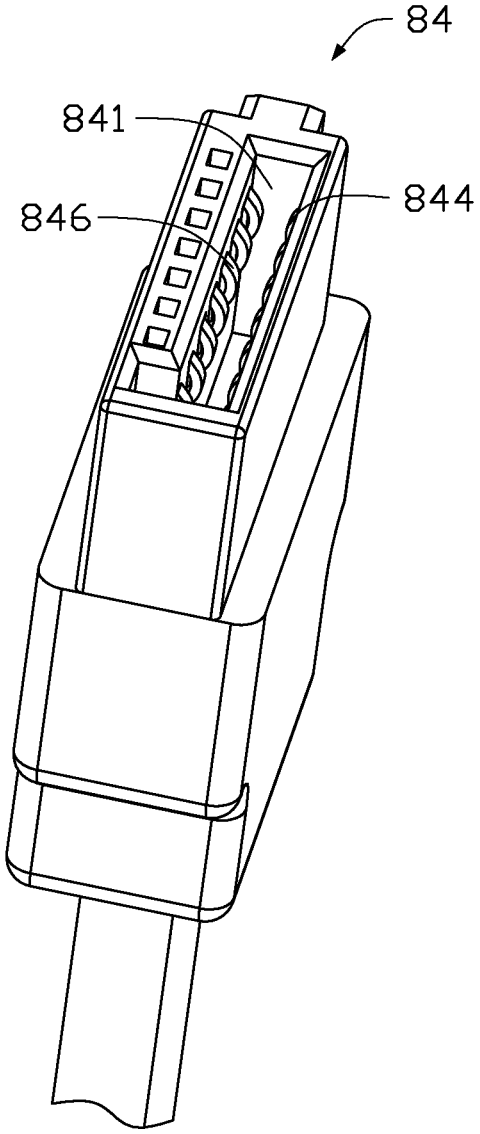
FIG. 6 is a partial, isometric view of a data cable of the connection system in FIG. 1.
Figure 7:
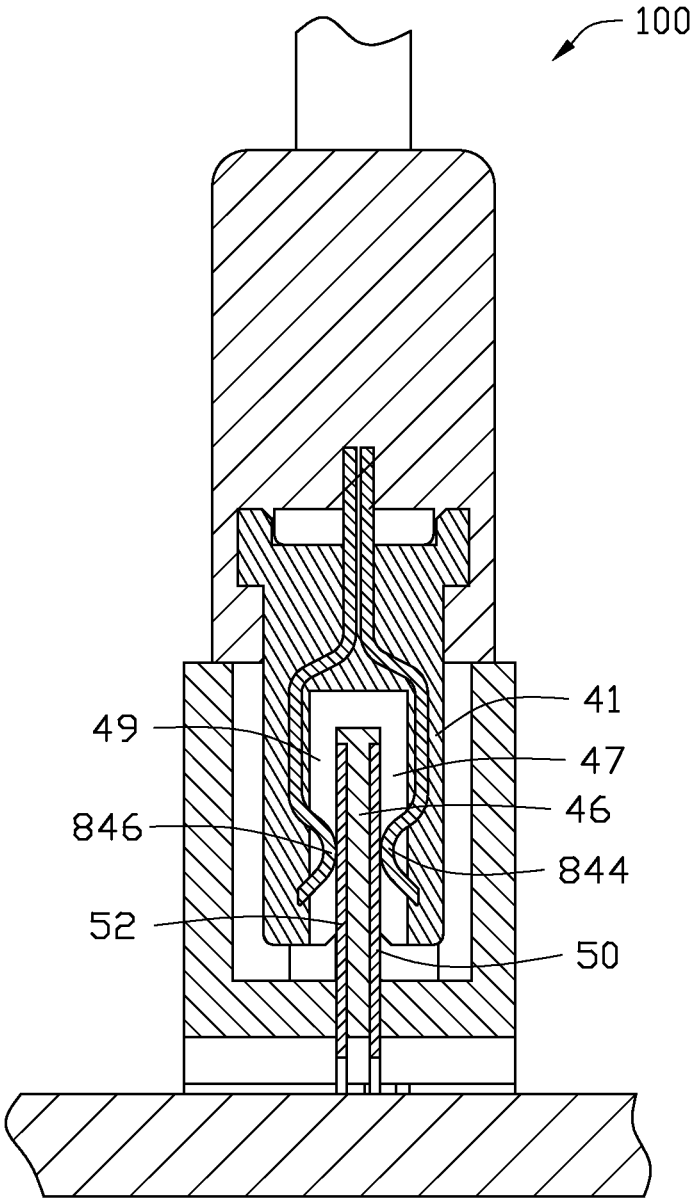
FIG. 7 is a partial, cross-sectional view of the connection system in FIG. 1.

FIGS. 6 and 7 illustrate the data cable 80 further includes a cable body 82. The connection port 84 is attached to one end of the cable body 82. The first data port 86 and the second data port 88 are connected to the other end of the cable body 82. The first data port 86 defines a slot 841. The slot 841 is configured to receive the division portion 46. A first terminal row 844 and a second terminal row 846 are attached in the slot 841. The first terminal row 844 is opposite to the second terminal row 846. The first terminal row 844 and the second terminal row 846 abut against to the first pin row 50 and the second pin row 52 when the division portion 46 is received in the slot 841 to electrically connect the motherboard 20 to the first terminal row 844 and the second terminal row 846. The cable body 82 includes a first cable 81 and a second cable 83. The first cable 81 and the second cable 83 are respectively connected to the first terminal row 844 and the second terminal row 846. The first data port 86 and the second data port 88 connects to the data port of the data ports of the first storage device 60 and the second storage device 70. Therefore, the motherboard 20 is electrically connected to the first storage device 60 and the second storage device 70.

In an embodiment the first pin row 50 and the second pin row 52 transmit a same signal. The first data port 86 is same as the second data port 88. The data port of the first storage device 60 is same as the data port of the second storage device 70. Thus, the connector 30 can be connected to two storage devices.

The embodiments shown and described above are only examples. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims.

What is claimed is:

1. A connector comprising:

an insulation body defining an opening and comprising a division portion dividing the opening to a first receiving groove and a second receiving groove;

a first pin row attached to a first side of the division portion;

a second pin row attached to a second side of the division portion opposite to the first side of the division portion;

a first connection terminal row attached to the insulation body, one of the ends of the first connection terminal row electrically connected to a motherboard, the other one of the ends of the first connection terminal row connecting to the first pin row; and a second connection terminal row attached to the insulation body, one of the ends of the second connection terminal row electrically connected to the motherboard, the other one of the ends of the second connection terminal row connecting to the second pin row.

2. The connector as claimed in claim 1, wherein the insulation body comprises a bottom portion and a sidewall surrounding the edge of the bottom portion, the bottom portion and a sidewall together define the opening.

3. The connector as claimed in claim 2, wherein the sidewall comprises two opposite first sidewalls and two opposite second sidewalls, the two first sidewalls are attached to the two second sidewalls.

4. The connector as claimed in claim 3, wherein the two first sidewalls are parallel to each other, the two second sidewalls are parallel to each other.

5. The connector as claimed in claim 4, wherein the division portion is perpendicular attached to the bottom portion and parallel positioned between the two first sidewalls.

6. The connector as claimed in claim 5, wherein the first pin row and the second pin row are perpendicular to the bottom portion and attached to two sides of the division portion facing to the two first sidewalls.

7. The connector as claimed in claim 1, wherein the insulation body further comprises a clasping member attached to a side of the bottom portion facing the motherboard, the clasping member is configured to attached to the motherboard.

8. The connector as claimed in claim 7, wherein the clasping member comprises two elastic members, a gap is defined between the two elastic members, an end of the elastic member away from the bottom portion comprises a hook portion.

9. A connector comprising:

an insulation body defining an opening;

a divider dividing the opening into a first receiving groove and a second receiving groove;

a first row of pins mounted on a first side of the divider;

a second row of pins mounted on a second side of the divider;

a first row of terminals attached to the insulation body, one of the ends of the first row of terminals configured to be electrically connected to a motherboard, the other one of the ends of the first row of terminals connecting to the first row of pins; and a second row of terminals attached to the insulation body, one of the ends of the second row of terminals configured to be electrically connected to the motherboard, the other one of the ends of the second row of terminals connecting to the second row of pins.

10. The connector as claimed in claim 9, wherein the insulation body comprises a bottom portion and a sidewall surrounding the edge of the bottom portion, the bottom portion and a sidewall together define the opening.

11. The connector as claimed in claim 10, wherein the sidewall comprises two opposite first sidewalls and two opposite second sidewalls, the two first sidewalls are attached to the two second sidewalls.

12. The connector as claimed in claim 11, wherein the two first sidewalls are parallel to each other, the two second sidewalls are parallel to each other.

13. The connector as claimed in claim 12, wherein the divider is perpendicular attached to the bottom portion and parallel positioned between the two first sidewalls.

14. The connector as claimed in claim 13, wherein the first pin row and the second pin row are perpendicular to the bottom portion and attached to two sides of the divider facing to the two first sidewalls.

15. The connector as claimed in claim 9, wherein the insulation body further comprises a clasping member attached to a side of the bottom portion facing the motherboard, the clasping member is configured to attached to the motherboard.

16. The connector as claimed in claim 15, wherein the clasping member comprises two elastic members, a gap is defined between the two elastic members, an end of the elastic member away from the bottom portion comprises a hook portion.

* * * * *